US006174131B1

(12) United States Patent
Janson

(10) Patent No.: US 6,174,131 B1
(45) Date of Patent: Jan. 16, 2001

(54) COMPRESSOR FOR GASES CONTAINING HYDROGEN SULFIDE

(75) Inventor: Gerd Janson, Oberhausen (DE)

(73) Assignee: GHH BORSIG Turbomaschinen GmbH, Oberhausen (DE)

( * ) Notice: Under 35 U.S.C. 154(b), the term of this patent shall be extended for 0 days.

(21) Appl. No.: 08/985,764

(22) Filed: Dec. 5, 1997

(30) Foreign Application Priority Data

Dec. 7, 1996 (DE) ..... 196 50 910

(51) Int. Cl.[7] ..... F04D 29/58
(52) U.S. Cl. ..... 415/179; 416/201 R
(58) Field of Search ..... 415/179, 199.1, 415/199.2, 199.3; 416/201 R, 185

(56) References Cited

U.S. PATENT DOCUMENTS 3,802,795 * 4/1974 Nyeste et al. ..... 415/179
3,902,823 * 9/1975 Minato et al. ..... 416/186 R

FOREIGN PATENT DOCUMENTS 970 801 10/1956 (DE) .
1 004 332 3/1957 (DE) .
1 428 170 1/1969 (DE) .
1 113 637 4/1956 (FR) .

OTHER PUBLICATIONS

MAN GHH, Jan. 1992, Standard Material Requirements—Sulfide Stress Cracking Resistant–Metallic Materials for Oilfield Equipment, NACE Standard MR0175–92 Item No. 53024.

Joseph A. Cameron et al., Jun. 1974, How to select materials for centrifugal compressor, HydrogCarbon Processing Jun. 1974, pp. 115–125.

* cited by examiner

*Primary Examiner*—Edward K. Look
*Assistant Examiner*—Richard Woo
(74) *Attorney, Agent, or Firm*—McGlew and Tuttle, P.C.

(57) ABSTRACT

A process gas compressor for the stepwise compression of process gases with increased percentage of hydrogen sulfide ($H_2S$), with an $H_2S$-uncritical area and an $H_2S$-critical area, in the housing (5) of which impellers (3) and (2) with a direction of flow to the right (7) and, after cooling (6), impellers (2) with a direction of flow to the left (8) are arranged on a shaft (1), wherein the impellers (3) and (2) are provided with blade ends (4). The transition from the uncritical $H_2S$ area to the critical $H_2S$ area takes place after the outlet of the first or second larger impeller (3) on the shaft on the left. This is followed by another impeller (2) with a direction of flow to the right (7), which is already located in the critical $H_2S$ area. The precompressed process gas is subsequently sent to a cooler (6) before it enters the impellers (2) in the critical $H_2S$ area of the process gas compressor at the second gas inlet stage (8) and leaves it at the housing outlet (9).

11 Claims, 3 Drawing Sheets

COMPRESSOR FOR GASES CONTAINING HYDROGEN SULFIDE

FIELD OF THE INVENTION

The present invention pertains to a compressor, especially a turbocompressor, for the stepwise compression of process gases containing increased percentages of hydrogen sulfide ($H_2S$) with at least one impeller arranged in the $H_2S$-uncritical area to the left in the direction of flow of the process gas and with at least one impeller in the $H_2S$-critical area to the left and, after an external intermediate cooling, with at least one (an) impeller arranged to the right and, in an alternative embodiment, to a compressor with the same direction of flow and without external intermediate cooling.

These process gases are hydrocarbon-containing C or CH gases. These gases are also called wet gases (in English), sour gases or hydrogen sulfide gases.

These turbocompressors are used in, e.g., chemical plants or refineries, e.g., in FCC processes.

BACKGROUND OF THE INVENTION

The NACE Standard MR0175, particularly of January 1992 applies as a guideline to turbocompressors that compress gases containing hydrogen sulfide. The standard defines an operation range in which the gas being handled is at a total pressure of 65 psia (448 kPa) or greater and the partial pressure of hydrogen sulfide in the gas is greater than 0.05 psia (0.34 kPa). This guideline stipulates that the yield point of the material and consequently also the circumferential velocity of a compressor impeller must not exceed a set limit value if a combination of gas pressure and hydrogen sulfide concentration in the gas, which combination is specified in this guideline, is exceeded.

The gas composition is approximately the same in all impellers of the compressor. The pressure of the gas increases in each compressor impeller, and the final pressure is reached after the last impeller.

If the guideline is applied to any one impeller of a turbocompressor, all impellers of the compressor are designed according to this guideline in the known manner.

If the guideline is applied to all impellers of a turbocompressor, even though it does not apply, e.g., to the first impeller, all impellers of the turbocompressor have a set maximum circumferential velocity of, e.g., 260 m/sec.

Compressors of the applicant for "wet gases" and similar gases have been known with, e.g., three impellers arranged to the left in the direction of flow and three impellers arranged to the right in the direction of flow. The process gas to be compressed enters at the housing on the left, is compressed in the impellers on the left, first in the uncritical $H_2S$ area, and then in the critical $H_2S$ area, and is subjected to intermediate cooling outside the compressor. The process gas then enters the compressor on the right-hand side of the housing, is compressed on the right in the critical $H_2S$ area, and it leaves the compressor in the middle.

The number of impellers on the compressor shaft on the left and right is determined by the external process conditions. The circumferential velocity of all impellers is below the maximum allowable circumferential velocity, which results from the yield point of the material of the impeller, which is lowered for the $H_2S$ conditions.

If a defined pressure value is not exceeded according to such guideline at a defined percentage of hydrogen sulfide in the process gas, the contents of this guideline do not apply.

SUMMARY AND OBJECTS OF THE INVENTION

The primary object of the present invention is therefore not to apply, as before, this guideline to all impellers of a compressor if the conditions of the guideline are met for at least one impeller, but to apply the guideline only to the compressor impellers for which these conditions apply, rather than to the impellers to which these conditions do not apply.

According to the invention, a compressor, especially a turbocompressor, for the stepwise compression of process gases with increased percentages of hydrogen sulfide ($H_2S$) is provided with at least one area that is uncritical for $H_2S$ with an impeller with blade end arranged to the left in the direction of flow of the process gas and with at least one $H_2S$-critical area to the left as well as with an impeller with blade end arranged to the right after (downstream from) an external intermediate cooling. The impeller diameter (the circumferential velocity) of at least one impeller is increased at equal speed of rotation in the $H_2S$-uncritical area. The yield point of the material of the impeller is not lowered to the $H_2S$-critical limit value. At least one impeller has an impeller diameter (circumferential velocity) lower than that of the said first impeller and a material with reduced yield point is arranged in the $H_2$-critical area.

According to another aspect of the invention, a compressor is provided, especially a turbocompressor, for the stepwise compression of process gases with increased percentage of hydrogen sulfide ($H_2S$) with at least one impeller with blade end arranged in the $H_2S$-uncritical area, and with at least one impeller with blade end and with the same direction of flow arranged in the $H_2S$-critical area. The impeller diameter (the circumferential velocity) of at least one impeller is increased at equal speed of rotation in the $H_2S$-uncritical area. The yield point of the material of this impeller is not reduced to the $H_2S$-critical limit value. At least one impeller has an impeller diameter (circumferential velocity) smaller than that of the first impeller and a material with reduced yield point is arranged in the $H_2S$-critical area.

If the guideline is not applied, e.g., to the first impeller of the turbocompressor, to which it does not apply, the circumferential velocity of this compressor impeller may be greater than that of the other impellers arranged on the compressor shaft (i.e., it may be greater than, e.g., 260 m/sec). In not applying the guideline or standard, the operation range is below a total pressure of 65 psia (448 kPa) for the gas being handled by the compressor or a partial pressure of hydrogen sulfide in the gas is less than 0.05 psia (0.34 kPa). Depending on other boundary conditions of the compression process, this can lead according to the present invention to a reduction in the size of the compressor and to a reduction in the number of compressor impellers.

According to the present invention, the gas inlet side of the first pressure stage of the compressor has or may have one compressor impeller fewer than the second pressure stage after cooling and reversal of the direction of flow instead of the same number of impellers at both stages.

Since the first impeller is not located in the critical $H_2S$ area, the circumferential velocity can be increased, because the yield point of the material of the first impeller of the first pressure stage does not need to be reduced to the $H_2S$ limit value.

The circumferential velocity is increased by increasing the impeller diameter at equal speed of rotation. The two impellers of the first pressure stage thus lead to approximately the same increase in pressure as the three impellers of the second pressure stage. The impellers of the second pressure stage in the critical $H_2S$ area remain unchanged.

In an alternative embodiment, a compressor is provided with the same direction of flow of the process gases to be compressed and without external intermediate cooling.

By saving one impeller, a commercial advantage is achieved over the prior-art embodiment. In addition, the first impeller of the first pressure stage, i.e., the impeller in the $H_2S$-uncritical area, can be made with or without blade end, while all other impellers must be equipped with blade ends.

The state of the art and the present invention will be explained in greater detail below on the basis of schematic drawings which show exemplary embodiments.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF FIG. 1

Figure 1:
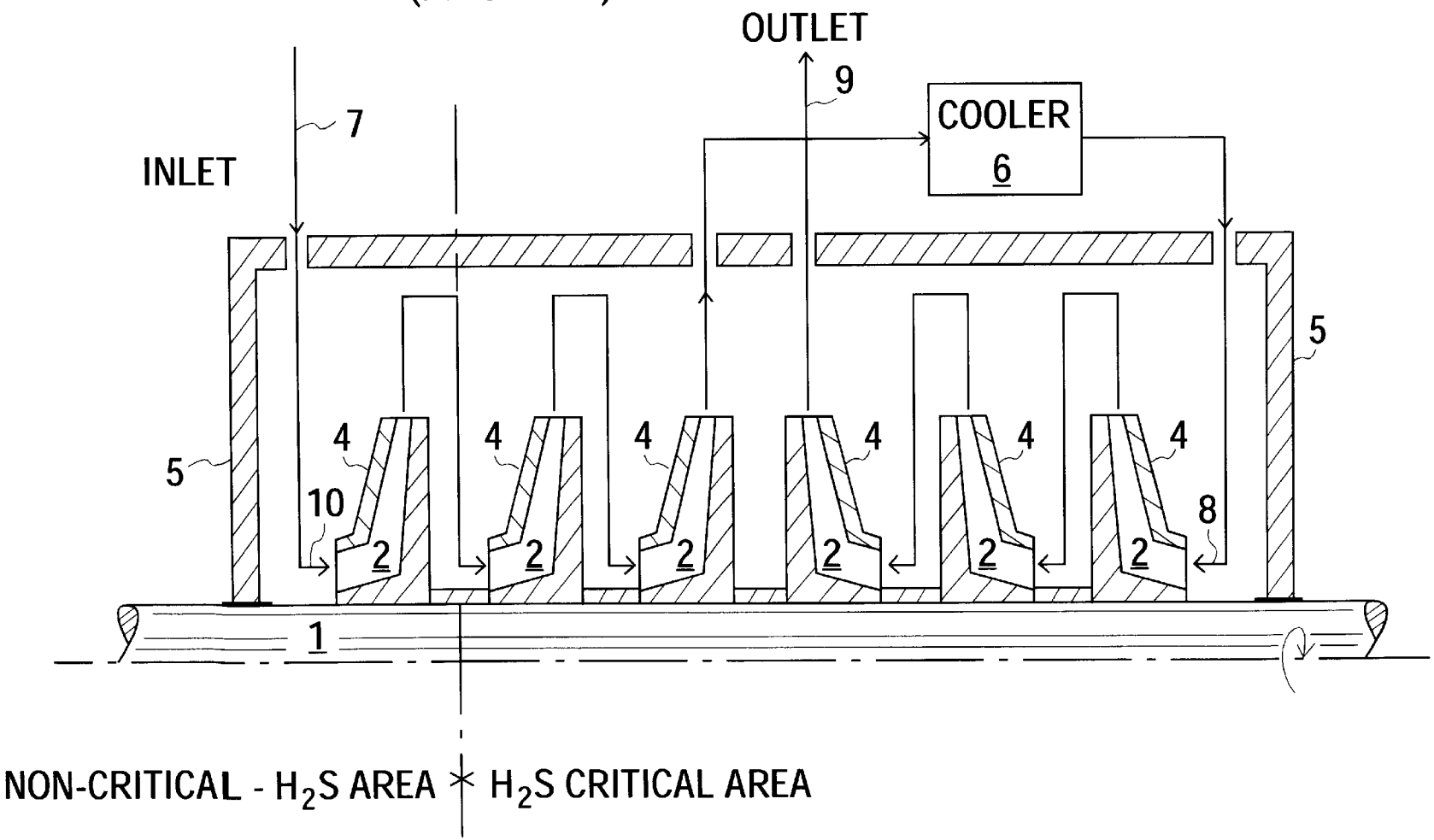
FIGURE 1 (PRIOR ART)
FIG. 1 is a sectional schematic view through a process gas compressor according to the prior art.

FIG. 1 shows a section through a process gas compressor with housing 5 according to the prior art.

The compressor is equipped with three impellers 2 with blade end 4 arranged to the left and to the right each on the shaft 1. The transition from the uncritical $H_2S$ area to the critical $H_2S$ area takes place after the outlet of the first impeller 2 arranged on the shaft 1 on the left. The $H_2S$-containing process gas to be compressed enters at the gas inlet 7 of the first stage, is compressed in the impellers 2 on the left-hand side of the process gas compressor, and is then subjected to the intermediate cooling in a cooling device 6 or heat exchanger outside the compressor. The process gas enters the compressor at the housing 5 on the right at the second gas inlet stage 8, is compressed in a direction of flow to the left, and it leaves the compressor at the gas outlet 9. The number of impellers 2 on the left and right is determined by the external process conditions.

The circumferential velocity of all impellers 2 is below the maximum allowable circumferential velocity, which results from the yield point of the impeller material, which was reduced for $H_2S$ conditions.

DESCRIPTION OF THE PREFERRED EMBODIMENTS

Figure 2:
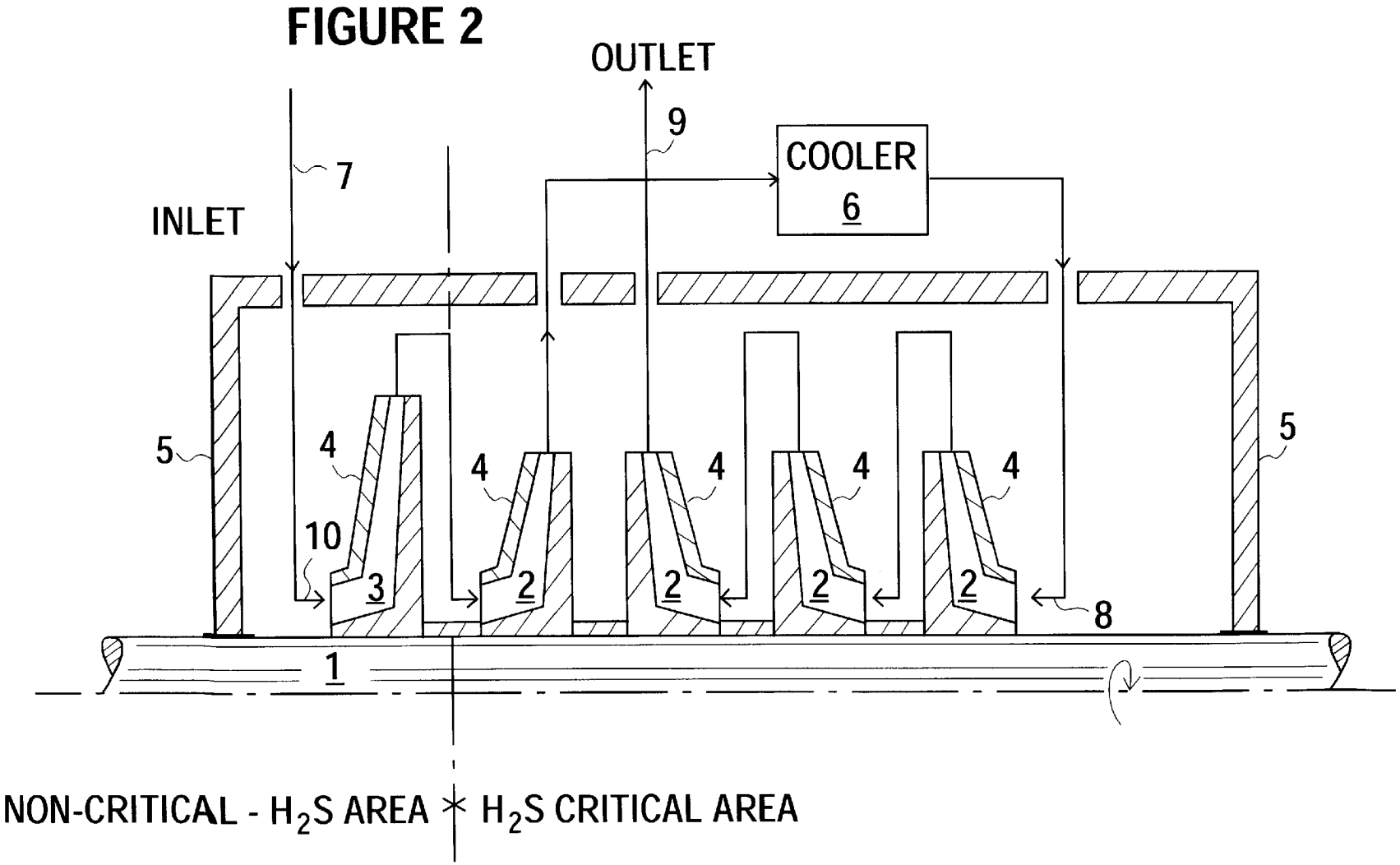
FIG. 2 is a sectional schematic view through a process gas compressor according to the present invention.

FIG. 2 shows a section through a process gas compressor according to the present invention, in the housing 5 of which two impellers 3 and 2 with blade ends 4 with direction of flow to the right 10 and, after the cooling 6, three impellers 2 with blade ends 4 with a direction of flow to the left 8 are arranged on a shaft 1.

The transition from the uncritical $H_2S$ area to the critical $H_2S$ area takes place after the outlet of the first larger impeller 3 arranged on the shaft on the left. This is followed by another impeller 2 with a direction of flow to the right 10, which is already located in the critical $H_2S$ area.

The precompressed process gas is subsequently fed to a cooler 6 before it enters the impellers 2 of the process gas compressor at the second gas inlet stage 8 and leaves the compressor at the gas outlet 9.

Since the first impeller 3 on the left is not located in the critical $H_2S$ area, the circumferential velocity of this impeller 3 can be increased by increasing the diameter, because the yield point of the material of this impeller 3 does not have to be reduced to the $H_2S$ limit value.

The two impellers 3 and 2 thus lead to approximately the same increase in pressure as do the three impellers 2 with a direction of flow to the left. The impellers 2 on the right on the shaft 1 remain unchanged and correspond to the design according to FIG. 1.

Figure 3:
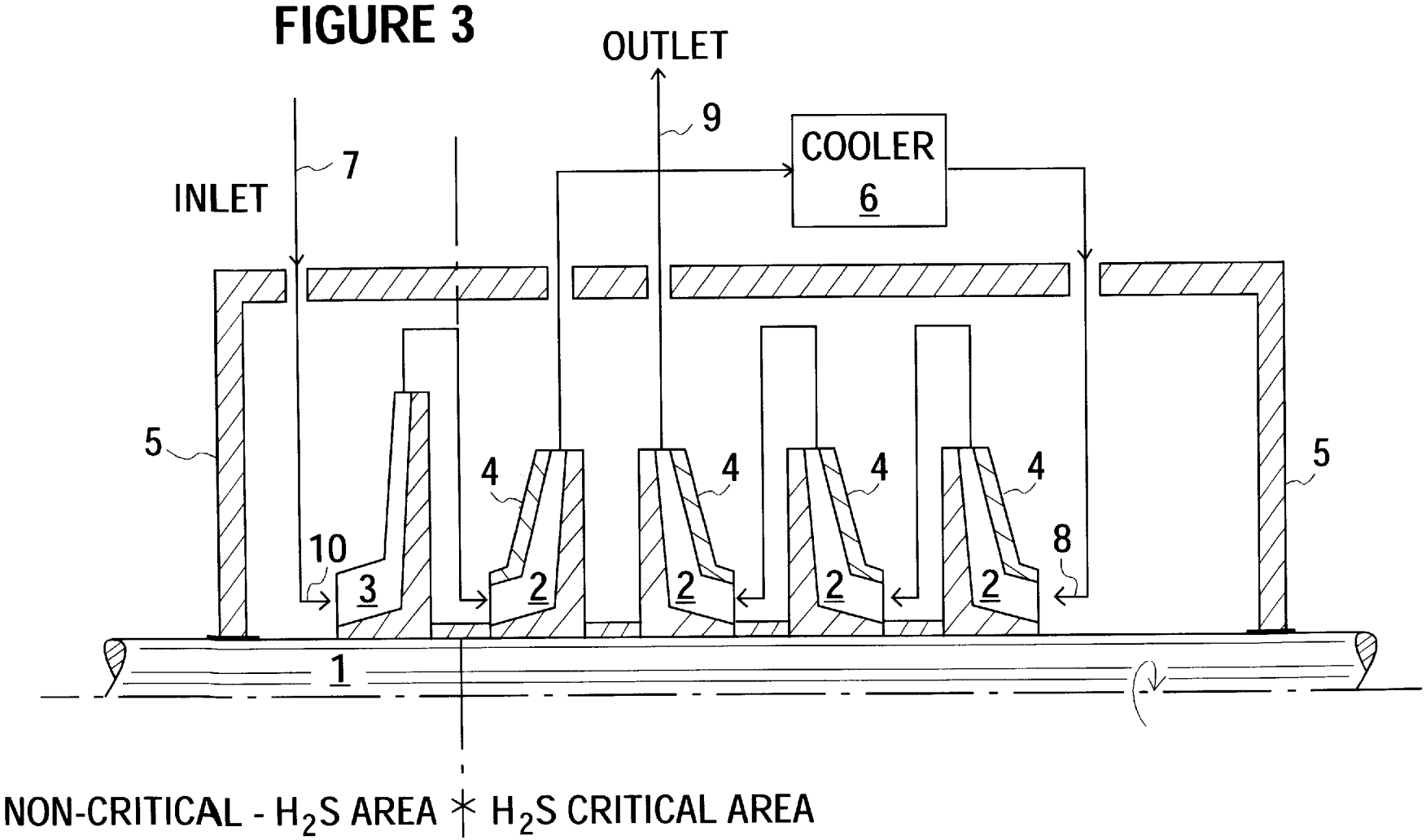
FIG. 3 is a sectional schematic view through a process gas compressor according to the present invention with the same process data as the compressor according to FIG. 2.

FIG. 3 shows a section through a process gas compressor according to the present invention on the same scale as FIG. 2 and with the compressor output.

The design is analogous to that according to FIG. 2, but the impellers 3 and 2 have an impeller diameter reduced by one size, and the housing 5 is analogously smaller by one size. The impeller 3 (is made) may be made with or without blade end 4 in this example, but the impellers 2 are provided with blade ends 4 in each direction of flow.

To achieve the preset increase in the pressure, the circumferential velocity of the impellers 3 and 2 on the compressor shaft 1 must remain unchanged. Thus, it remains below the $H_2S$ limit for all impellers 2 except the left-hand impeller 3, which is in the uncritical $H_2S$ area.

The constant circumferential velocity is achieved with impellers 3 and 2 of a smaller diameter by increasing the speed of rotation.

While specific embodiments of the invention have been shown and described in detail to illustrate the application of the principles of the invention, it will be understood that the invention may be embodied otherwise without departing from such principles.

What is claimed is:

1. A compressor for compressing hydrogen sulfide in which the gas being handled is at a total pressure of 65 psia (448 kPa) or greater and the partial pressure of hydrogen sulfide in the gas is greater than 0.05 psia (0.34 kpa), the compressor comprising:

a housing;

a first impeller arranged in said housing and for compressing the hydrogen sulfide, said first impeller having a parameter causing said first impeller to operate below a total pressure of 65 psia (448 kPa) for the gas being handled by said compressor or a partial pressure of hydrogen sulfide in the gas is less than 0.05 psia (0.34 kPa), during operation of the compressor;

a second impeller arranged in said housing and for further compressing the hydrogen sulfide from said first impeller, said second impeller being formed to operate at a total pressure of 65 psia (448 kPa) or greater for the gas being handled by said compressor and at a partial pressure of hydrogen sulfide in the gas is greater than 0.05 psia (0.34 kPa), during operation of the compressor.

2. The compressor in accordance with claim 1, wherein:

said parameter of said first impeller is one of a size and a material of said first impeller.

3. The compressor in accordance with claim 1, wherein:

said parameter of said first impeller is a size of said first impeller.

4. The compressor in accordance with claim 1, wherein:

said housing includes a housing intermediate portion;

said first impeller has an impeller diameter, providing a circumferential velocity, which is increased relative to said second impeller, at equal speed of rotation and having a yield point of material which is not lowered to a $H_2S$-critical limit value;

a first plurality of impellers are arranged in said housing on one side of said housing intermediate portion and including said first and second impellers, said first plurality of impellers having a direction of flow toward said housing intermediate region;

a second plurality of impellers are arranged in said housing on another side of said housing intermediate portion, said second plurality of impellers having a direction of flow toward said housing intermediate region, said second plurality of impellers being downstream from said first plurality of impellers, said first and second plurality of impellers providing for stepwise compression of process gases with increased percentages of the hydrogen sulfide ($H_2S$) with at least one area that is uncritical for $H_2S$ in said first plurality of impellers and with at least one $H_2S$-critical area in said first plurality of impellers;

said second impeller has an impeller diameter, providing a circumferential velocity which is lower than that of said first impeller and is formed of a material with reduced yield point, said second impeller being arranged in said $H_2S$-critical area;

an external intermediate cooler disposed between said first and said second plurality of impellers in terms of flow.

5. The compressor in accordance with claim 4, wherein:

said first and second plurality of impellers are arranged on a shaft;

said first impeller is arranged in said $H_2S$-critical area and is provided without a blade end;

said second impeller includes a blade end.

6. A process for stepwise compression of process gases with increased percentages of hydrogen sulfide ($H_2S$) through a compressor, the process comprising the steps of:

compressing process gas in a compressor having at least one area of said compressor that is uncritical for $H_2S$ with an impeller with blade end arranged at a compressor left side portion with a left to right direction of flow of the process gas;

providing at least one $H_2S$ critical area in the left side portion well as with an impeller with blade end arranged at a compressor right side portion, said right side portion being downstream of said left side portion;

increasing a circumferential velocity of at least said one impeller having an impeller diameter at said left side portion which is increased relative to at least another said impeller, at equal rotation;

causing a yield point of material of said at least one said impeller is not lowered to a hydrogen sulfide critical limit value; and lowering a circumferential velocity of said at least another impeller having an impeller diameter relative to that of said at least one said impeller, said at least another impeller is formed of a material with a reduced yield point and said at least another impeller being arranged in said hydrogen sulfide critical area.

7. A process for compressing hydrogen sulfide ($H_2S$), the process comprising the steps of:

providing a housing;

providing a first impeller arranged in said housing;

feeding hydrogen sulfide to said first impeller;

rotating said first impeller for initially compressing the hydrogen sulfide, said rotating being performed to initially compress the hydrogen sulfide outside a scope of NACE Standard MR0175 of January, 1992;

providing a second impeller arranged in said housing;

feeding the hydrogen sulfide from said first impeller to said second impeller;

rotating said second impeller for further compressing the hydrogen sulfide, said rotating of said second impeller being performed to further compress the hydrogen sulfide within the scope of NACE Standard MR0175 of January, 1992.

8. The process in accordance with claim 7, wherein:

one of a size, a material and a speed of said first impeller is outside the scope of NACE Standard MR0175 of January, 1992 during said initial compressing.

9. The process in accordance with claim 7, wherein:

a circumferential velocity of said first impeller is outside the scope of NACE Standard MR0175 of January, 1992 during said initial compressing.

10. The process in accordance with claim 7, wherein:

said housing includes a housing intermediate portion;

said first impeller has an impeller diameter, providing a circumferential velocity, which is increased relative to said second impeller, at equal speed of rotation and having a yield point of material which is not lowered to a $H_2S$-critical limit value;

a first plurality of impellers are arranged in said housing on one side of said housing intermediate portion and including said first and second impellers, said first plurality of impellers having a direction of flow toward said housing intermediate region;

a second plurality of impellers are arranged in said housing on another side of said housing intermediate portion, said second plurality of impellers having a direction of flow toward said housing intermediate region, said second plurality of impellers being downstream from said first plurality of impellers, said first and second plurality of impellers providing for stepwise compression of process gases with increased percentages of the hydrogen sulfide ($H_2S$) with at least one area that is uncritical for $H_2S$ in said first plurality of impellers and with at least one $H_2S$-critical area in said first plurality of impellers;

said second impeller has an impeller diameter, providing a circumferential velocity which is lower than that of said first impeller and is formed of a material with reduced yield point, said second impeller being arranged in said $H_2S$-critical area;

an external intermediate cooler disposed between said first and said second plurality of impellers in terms of flow.

11. The process in accordance with claim 10, wherein:

said first and second plurality of impellers are arranged on a shaft;

said first impeller is arranged in said $H_2S$-critical area and is provided without a blade end;

said second impeller includes a blade end.

* * * * *